US008647150B2

(12) United States Patent
Fujiwara et al.

(10) Patent No.: US 8,647,150 B2
(45) Date of Patent: Feb. 11, 2014

(54) WATER PROOF TYPE ELECTRICAL CONNECTOR

(75) Inventors: Yoshihito Fujiwara, Tokyo (JP); Katsumi Shiga, Chiba (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 1336 days.

(21) Appl. No.: 11/689,773

(22) Filed: Mar. 22, 2007

(65) Prior Publication Data

US 2007/0224881 A1 Sep. 27, 2007

(30) Foreign Application Priority Data

Mar. 24, 2006 (JP) ..... 2006-82168

(51) Int. Cl.
*H01R 13/40* (2006.01)

(52) U.S. Cl.
USPC ..... 439/587

(58) Field of Classification Search
USPC ..... 439/583, 587, 271, 352, 188
See application file for complete search history.

(56) References Cited

U.S. PATENT DOCUMENTS

| | | | | |
|---|---|---|---|---|
| 3,352,982 | A * | 11/1967 | Walther | 200/51.07 |
| 5,145,356 | A * | 9/1992 | Minnis | 439/352 |
| 5,382,174 | A * | 1/1995 | Kinoshita | 439/271 |
| 5,484,302 | A * | 1/1996 | Yamada et al. | 439/326 |
| 6,039,585 | A * | 3/2000 | Kim et al. | 439/137 |
| 6,659,789 | B2 * | 12/2003 | Nagamine et al. | 439/352 |
| 2004/0229506 | A1 * | 11/2004 | Asao | 439/587 |
| 2004/0266243 | A1 * | 12/2004 | Murakami | 439/271 |
| 2005/0003708 | A1 * | 1/2005 | Fukuda et al. | 439/583 |
| 2005/0009390 | A1 * | 1/2005 | Barker et al. | 439/188 |
| 2005/0048837 | A1 * | 3/2005 | Ichida et al. | 439/595 |
| 2005/0176295 | A1 * | 8/2005 | Morita et al. | 439/587 |
| 2005/0176296 | A1 * | 8/2005 | Montena | 439/587 |
| 2005/0245130 | A1 * | 11/2005 | Shiga et al. | 439/587 |
| 2006/0205268 | A1 * | 9/2006 | Hayashi et al. | 439/488 |

FOREIGN PATENT DOCUMENTS

| | | |
|---|---|---|
| JP | 8-045601 A | 2/1996 |
| JP | 2004-069242 | 3/2004 |
| JP | 2004-193079 | 7/2004 |
| JP | 2005-050685 | 2/2005 |

OTHER PUBLICATIONS

State Intellectual Property Office, P.R China First Office Action dated Mar. 11, 2010 in co-pending chinese Patent Application No. 200710089733.7, 3 pages.
Notification of Reasons for Refusal in copending Japanese Patent Application No. 2006-082168, 7 pages, dated Jun. 15, 2010.

* cited by examiner

*Primary Examiner* — Amy Cohen Johnson
*Assistant Examiner* — Vladimir Imas
(74) *Attorney, Agent, or Firm* — Barley Snyder

(57) ABSTRACT

A waterproof electrical connector for electrically connecting wiring to a mating connector having a concavity, the waterproof electrical connector having a contact connected to an end of a wire, a housing having a fitting section configured to at least partially house the contact and configured for insertion into the concavity, a seal integrally arranged on an outer periphery surface near a top end of the fitting section, which sealingly contacts an inner wall of the concavity when the fitting section is inserted into the concavity, and a lock which prevents the housing from exiting the concavity once the fitting section has been inserted into concavity to a predetermined depth is disclosed.

23 Claims, 8 Drawing Sheets

WATER PROOF TYPE ELECTRICAL CONNECTOR

CROSS-REFERENCE TO RELATED APPLICATIONS

This application claims the benefit of the filing date under 35 U.S.C. §119(a)-(d) of Japanese patent application document 2006-082168 of Mar. 24, 2006.

FIELD OF THE INVENTION

The present invention relates to an electrical connector, and particularly to a waterproof electrical connector.

BACKGROUND

Conventionally, among electrical connectors, waterproof connectors which prevent water from entering the connecting portion with a mating connector are known. The air bag systems of automobiles send an electrical signal to the ignition device to cause an explosion, and the gas generated from the explosion fills the air bag. The wiring which sends the electrical signal in the air bag system is connected to the mating connector on the ignition device through an electrical connector. Recently, air bag devices have come to be installed not only in the steering portion in the interior of automobiles, but also, inside the doors as a curtain air bag or a side air bag. Since condensation or the like is more likely to be formed inside the doors compared with the interior, the connectors used inside the doors needs to be waterproof For this reason, waterproof electrical connectors equipped with waterproof rings made of elastic materials have been proposed (see, for example, Japanese Patent Application Laid-open Publications Nos. 2004-193079 and 2005-050685).

Prior Art FIG. 8 and Prior Art FIG. 9 are cross-sectional views showing the conventional waterproof electrical connectors.

Prior Art FIG. 8 shows a waterproof connector 80 which is connected to a mating connector 85 on the ignition device side, while the inner structure of the waterproof connector 80 is omitted. A waterproof ring 82 made of an elastic material is attached to the outer periphery portion of a housing 81 of the waterproof connector 80. When the waterproof connector 80 is fitted into the mating connector 85, contacts (not shown) provided to both of the waterproof connector 80 and the mating connector 85 come into contact with each other. Furthermore, the waterproof ring 82 closely contacts the aperture portion of a contact-receiving concave portion of the mating connector 85, and thus seals the gap between the contact-receiving concave portion and the housing 81.

A waterproof connector 90 shown in Prior Art FIG. 9 is a different type of waterproof connector from that shown in Prior Art FIG. 8. The outer diameter of a waterproof ring 92 is formed to be larger than the diameter of the aperture of the contact-receiving concave portion of a mating connector 95. Accordingly, when a housing 91 is inserted into and received by the contact-receiving concave portion of the mating connector 95, the housing 91 is locked with the mating connector 95, while the waterproof ring 92 is held between the housing 91 and the rims of the contact-receiving concave portion of the mating connector 95 in the direction of insertion. The waterproof connectors 80 and 90 shown, respectively, in Prior Art FIG. 8 and Prior Art FIG. 9, make the connecting portions of the contacts waterproof.

However, some connectors have a notch formed on the aperture portion of the contact-receiving concave portion thereof in prevent relative rotational movement between the waterproof connector and the mating connector. When the conventional waterproof connecter 80 or 90 is fitted into mating connectors having a notch for preventing rotational movement, a gap is formed at the position where the notch is formed, compromising the waterproof seal. Moreover, the waterproof connector 90 shown in Prior Art FIG. 9 is locked with the mating connector 95 while the waterproof ring 92 is tightly held by the aperture portion of the mating connector 95. As a result, the waterproof ring 92 continues to be pressed strongly and is worn out, compromising the waterproof seal.

Further, if a sealing member is attached to a housing after the sealing member is formed as a separate waterproof ring, a groove (or the like) for attaching the waterproof ring and a securing member for securing the waterproof ring are required to be formed in the housing. As squib connectors have been miniaturized to fit to the mating connectors that have also been miniaturized, the thickness of the fitting section of the housing has become thin. As a result, it is difficult to attach the waterproof ring and the securing member for the waterproof ring without altering the contour structure of the squib connectors.

SUMMARY

The present invention relates to a waterproof electrical connector for electrically connecting wiring to a mating connector having a concavity, the waterproof electrical connector having a contact connected to an end of a wire, a housing having a fitting section configured to at least partially house the contact and configured for insertion into the concavity, a seal integrally arranged on an outer periphery surface near a top end of the fitting section, which sealingly contacts an inner wall of the concavity when the fitting section is inserted into the concavity, and a lock which prevents the housing from exiting the concavity once the fitting section has been inserted into concavity to a predetermined depth.

BRIEF DESCRIPTION OF THE DRAWINGS

The above and other objects, features and other advantages of the present invention will be more clearly understood from the following detailed description taken in conjunction with the accompanying drawings, in which.

Prior Art

DETAILED DESCRIPTION OF THE EMBODIMENT(S)

Description will be made of an embodiment of the present invention below with reference to the accompany drawings.

FIG. 1*a* to FIG. 3 show a squib connector 10 which is an embodiment of a waterproof electrical connector according to the present invention.

Figure 1:
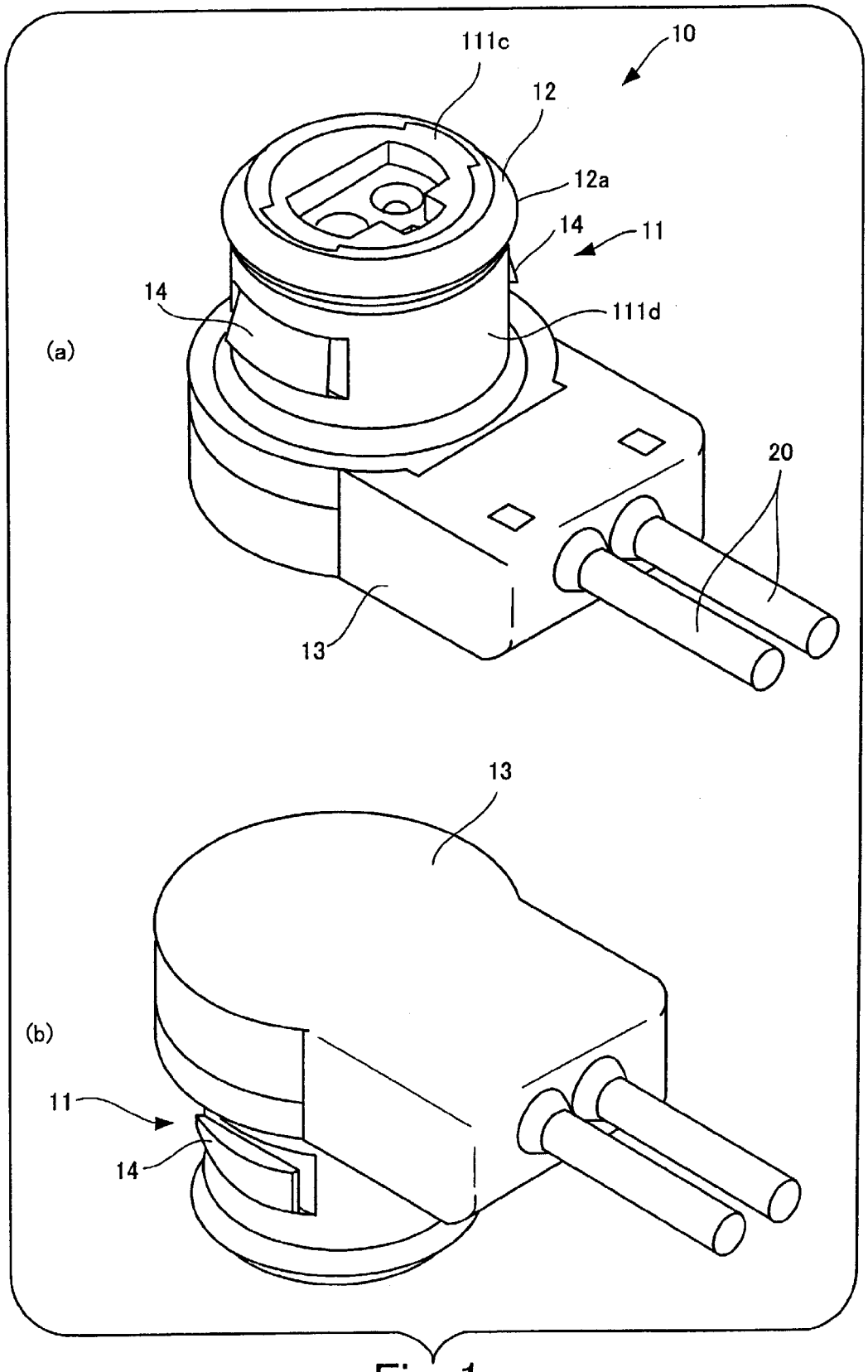
FIG. 1*a* is an oblique view of a squib connector according to an embodiment of the present invention.
FIG. 1*b* is another oblique view of the squib connector of FIG. 1*a;*
Figure 2:
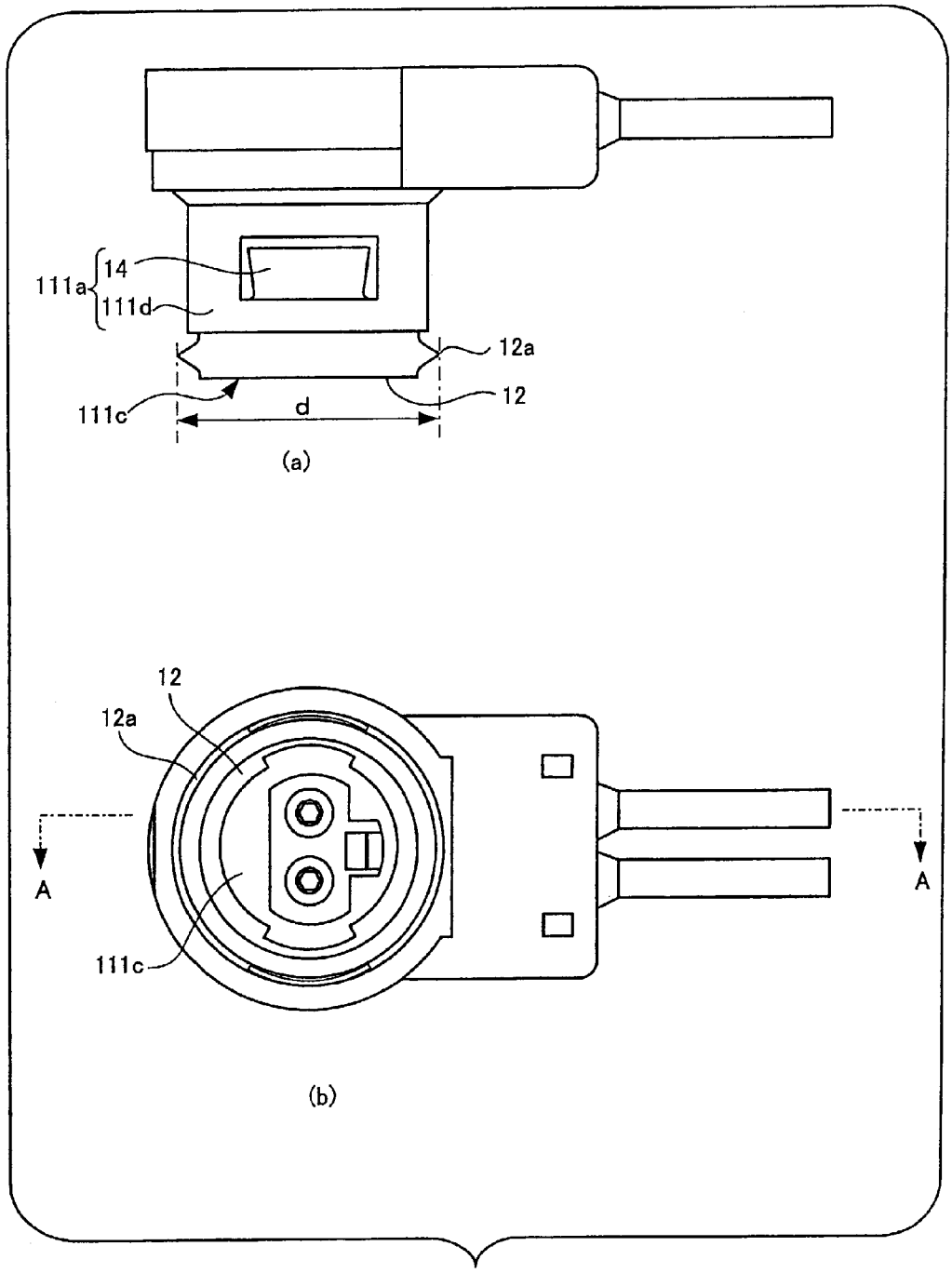
FIG. 2*a* is an orthogonal view of the squib connector of FIG. 1*a;*
FIG. 2*b* is another orthogonal view of the squib connector of FIG. 1*a;*
Figure 3:
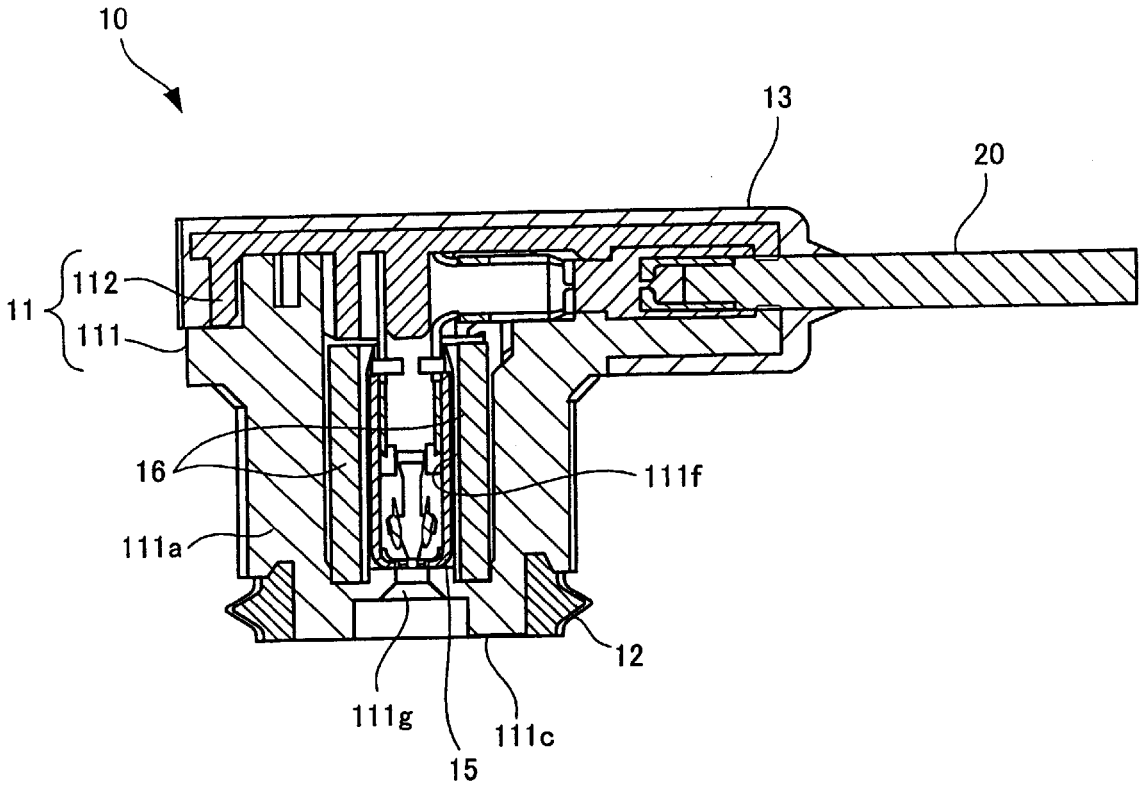
FIG. 3 is a cross-sectional view of the squib connector of FIG. 1*a* taken along the line A-A of FIG. 2*b;*

FIG. 1*a* is an oblique view of the squib connector 10 showing the top end surface thereof to be fitted to a mating connector and FIG. 1*b* is an oblique view of the squib connector 10 showing a side surface thereof as viewed from the opposite side of the top end. FIG. 2*a* is a side surface view of the squib connector 10 and of FIG. 2*b* is a front surface view thereof. FIG. 3 is a cross-sectional view taken along the line A-A of FIG. 2*b*.

The squib connector 10 connects wiring or wires 20 to a mating connector (not shown) which is associated with the ignition device of an automobile air bag. The squib connector 10 includes an insulative housing 11, a seal 12, a body 13 (which may be formed of molded resin), and a lock 14. The housing 11 includes a fitting section 111*a* which fits into a contact-receiving concavity 51 of the mating connector 50. Moreover, as shown in FIG. 3, inside the housing 11 of the squib connector 10, provided are a contact 15 connected to an end of each wire 20 and a ferrite core 16 for the absorption of external noise. The contact 15 and the ferrite core 16 are accommodated in a contact chamber 111*f* formed in a housing main body 111 of the housing 11. At a top end 111*c* of the fitting section 111*a*, an aperture 111*g* is formed. The aperture 111*g* communicates the contact chamber 111*f* to the outside. When the squib connector 10 is connected to the mating connector, a mating contact of the mating connector is inserted into the contact chamber 111*f* while extending through the aperture 111*g* to come into contact with the contact 15.

Figure 4:
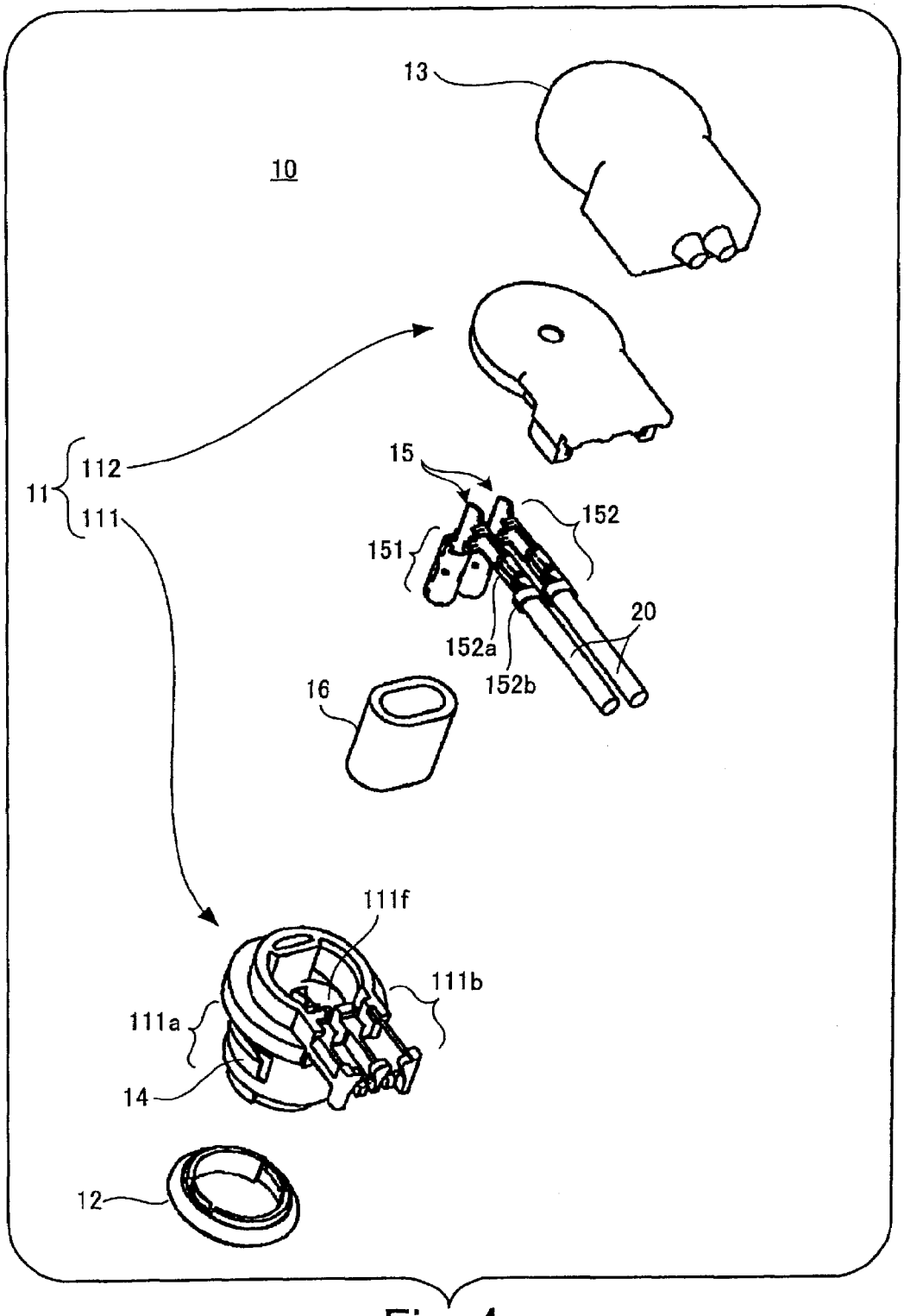
FIG. 4 is an oblique exploded view of the squib connector of FIG. 1*a;*

FIG. 4 is an oblique exploded view of the squib connector 10.

The squib connector 10 may be manufactured as follows. First, the ferrite core 16 and the contacts 15 connected to the wires 20 and are inserted into the contact chamber 111*f* of the housing main body 111 on which the seal 12 is integrally formed. Next, a lid 112 is mounted on the housing main body 111. Then, the body 13 is formed outside the housing 11.

Now, descriptions will be made of components that constitute the squib connector 10 with reference to FIG. 4.

The contact 15 may be, for example, a contact to be fitted to a male mating contact of the mating connector, and may be formed through the processes of punching a metal plate with a die, bending, and plating. The contact 15 is approximately L-shaped, and includes a contacting portion 151 which contacts the mating contact of the mating connector, and a wire connecting portion 152 which is connected to the wire 20. The wire connecting portions 152 include a conductor crimp section 152*a* which crimps the core wiring of the wire 20, and an insulation crimp section 152*b* which crimps the insulation of the wire 20.

The housing 11 includes the housing main body 111 and the lid 112, both of which may be formed of an insulated synthetic resin. In the housing main body 111 of the housing 11, the fitting section 111*a* and a crimp supporting section 111*b* are formed. The fitting section 111*a* has a substantially columnar shape and fits into the concavity 51 of the mating connector 50. The crimp supporting section 111*b* retains the wire 20. The housing 11 retains the contact 15 and the wire 20 such that the contact 15 and the wire 20 are sandwiched between the housing main body 111 and the lid 112. Moreover, as shown in FIG. 1*a*, on an outer periphery surface 111*d* (see FIG. 2*a*) of the fitting section 111*a* of the housing 11, the locks 14 are formed. The lock 14 prevents the fitting section 111*a* from exiting the concavity 51 of the mating connector 50 when the fitting section 111*a* is inserted in the concavity 51 of the mating connector 50 up to a predetermined depth. The lock 14 is integrally formed with the housing main body 111.

FIG. 4 shows the seal 12 that is described for simplicity as being separated from the housing main body 111. After manufacturing the connector, the seal 12 is integrally formed on the housing main body 111. The seal 12 is formed by insert-molding oil-impregnated silicone rubber on the outer periphery surface 111*d* of the already-formed housing main body 111. The oil-impregnated silicone rubber is adhered to the housing main body 111 in the insert-molding process, forming the seal 12 integrated with the housing main body 111. Note that silicone rubber and the like can be used instead of the oil-impregnated silicone rubber as the material of the seal 12. Alternatively, the seal 12 can be integrally formed on the housing main body 111 at the same time with double injection molding. As shown in FIG. 2*a* and FIG. 2*b*, the seal 12 is integrally arranged on the outer periphery surface 111*d* near the top end 111*c* of the fitting section 111*a*. The seal 12 is formed as a ring shape surrounding a part of the outer periphery surface 111*d*, and a lip 12*a* (see FIG. 1*a*) is formed on the outermost periphery of the seal 12. The lip 12*a* projects outward from the outer periphery surface 111*d*. The outer diameter d of the seal 12 (see FIG. 2*a*) is larger than the inner diameter of the concavity 51 of the mating connector 50. Specifically, the seal 12 is formed so as to sealingly and elastically contact the inner wall of the concavity 51 when the fitting section 111*a* is inserted into the concavity 51.

By integrally arranging the seal 12 on the outer periphery surface 111*d* with insert-molding or double injection molding, it is possible to arrange the seal 12 on the outer periphery surface 111*d* near the top end 111*c* of the fitting section 111*a*.

In the squib connector 10 of this embodiment, the seal 12 is integrally arranged on the outer periphery surface 111*d* near the top end 111*c* of the fitting section 111*a* by insert-molding or double injection molding. Consequently, the space for disposing the seal 12 can be reduced compared with a case of attaching the waterproof ring and the securing member for the waterproof ring to the finished housing 11 after separately forming the waterproof ring. Thus, according to the squib connector 10 of this embodiment, it is possible to arrange the seal 12 on the outer periphery surface 111*d* near the top end 111*c* of the fitting section 111*a* without altering the contour structure or the dimension of the connector.

FIG. 4 shows the body 13 that is described for simplicity as being separated from the housing 11. After manufacturing the connector 10, the body 13 is integrally formed on the housing 11. The body 13 is formed by insert-molding a hot melt material on the outside of the housing 11 with the wire 20 being held tightly by the housing 11 and guided therefrom. A polyamide hot melt material formed at a low pressure and having high adhesiveness may be used as the hot melt material. As shown in FIG. 3, the body 13 covers a part of the housing main body 111 and the entire surface of the lid 112, and fills the joint between the housing main body 111 and the lid 112 including a portion at which the wire 20 is held. In other words, the wire 20 is adhered to the housing main body 111 with the hot melt material of the body 13. In this respect, the hot melt material reduces the formation of the gap, caused by the heat cycle, between the housing 11 and the wire 20, and thereby, the waterproof sealing property is efficiently maintained at the portion between the housing 11 and the wire 20. Note that a polyester hot melt material, which has high heat resistance in addition to high adhesiveness and formability at low pressure, can be used as the material of the body 13 instead of a polyamide hot melt material.

Figure 5:
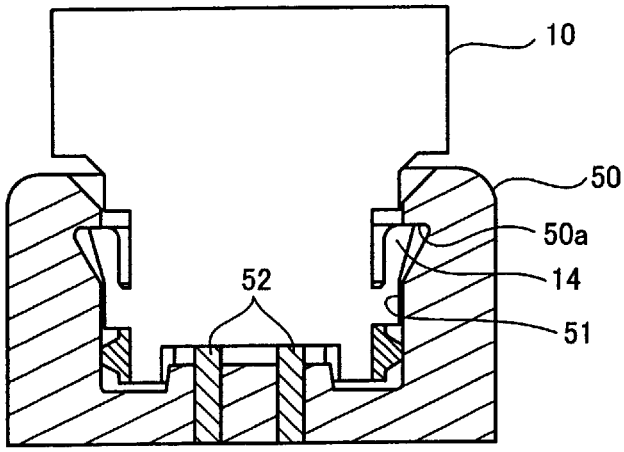
FIG. 5 is a cross-sectional view of the squib connector of FIG. 1*a* showing the squib connector connected to a mating connector.
Figure 6:
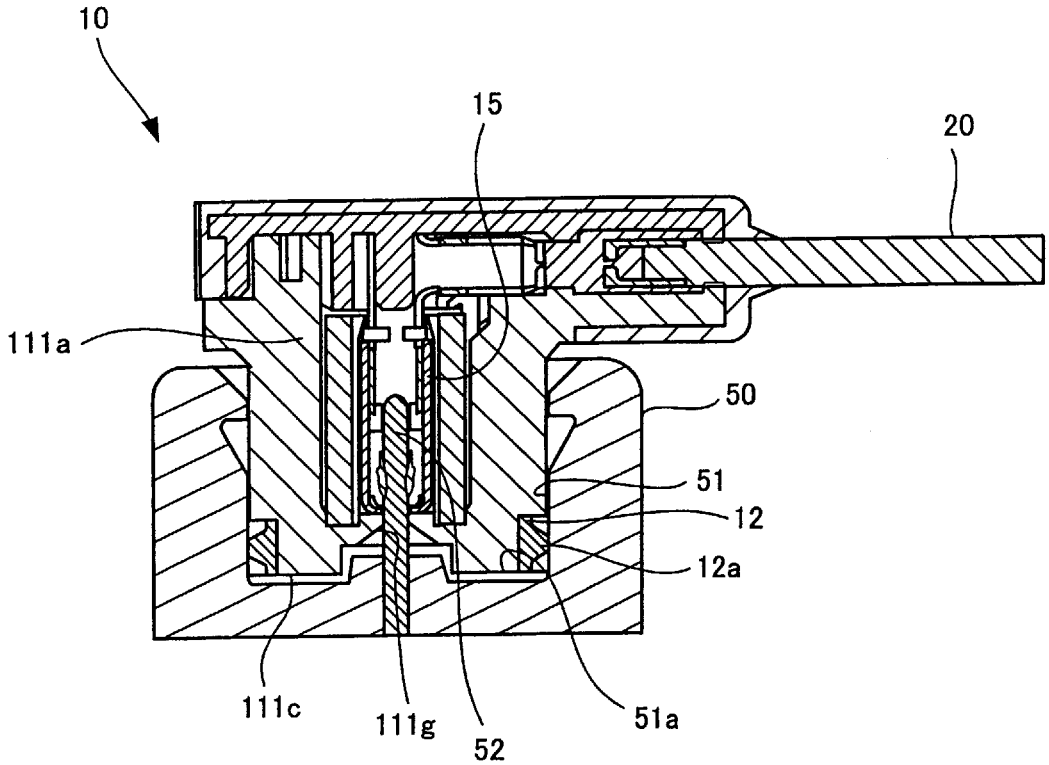
FIG. 6 is another cross-sectional view of the squib connector of FIG. 1*a* showing the squib connector connected to a mating connector.

FIG. 5 and FIG. 6 are cross-sectional views showing squib connector 10 connected to the mating connector 50.

On mating connector 50, a contact-receiving concavity 51 is formed. Two mating contacts 52 (partially shown in FIG. 5) are arranged inside the concavity 51.

As shown in FIG. 6, when the fitting section 111*a* of the squib connector 10 is inserted and fitted into the concavity 51, the mating contacts 52 are inserted into the contact chamber 111*f* while extending through the aperture 111*g* to come into contact with the contact 15. Consequently, the wire 20 is electrically connected to the mating connector 50. Moreover, as shown in FIG. 5, the fitting section 111*a* is inserted up to a predetermined depth of the concavity 51 where the top end 111*c* of the fitting section 111*a* almost reaches a bottom 51*a* of the concavity 51. Then, the lock 14 is engaged with an engaging portion 50*a* of the mating connector 50, and prevents the housing 11 from exiting the concavity 51. Moreover, the lip 12*a* of the seal 12 is pressed against the inner wall of the concavity 51, and sealingly and elastically contacts the inner wall. Thus, the seal 12 seals the gap between the top end 111*c* of the fitting section 111*a* and the concavity 51. The seal effectively prevents water that enters from the gap between the fitting section 111*a* and the concavity 51 from further entering the gap between the top end 111*c* of the fitting section 111*a* and the concavity 51. In this way, it is possible to make the connecting portion between the contact 15 and the mating contact 52 waterproof.

Figure 7:
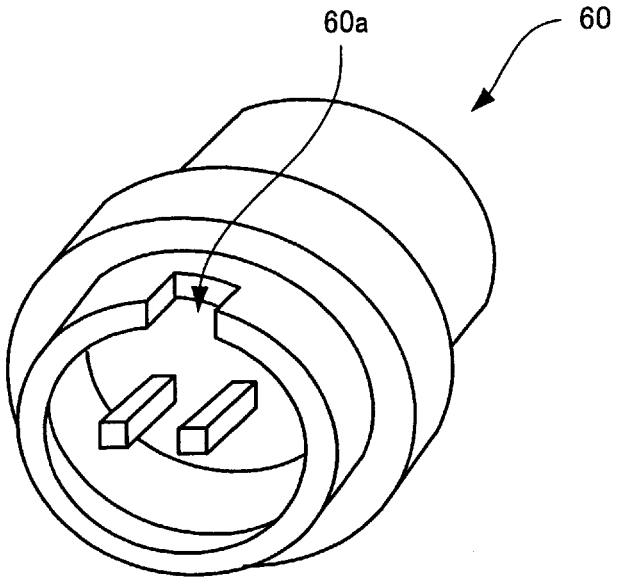
FIG. 7 is an oblique of a mating connector having a notch according to the present invention.
Figure 8:
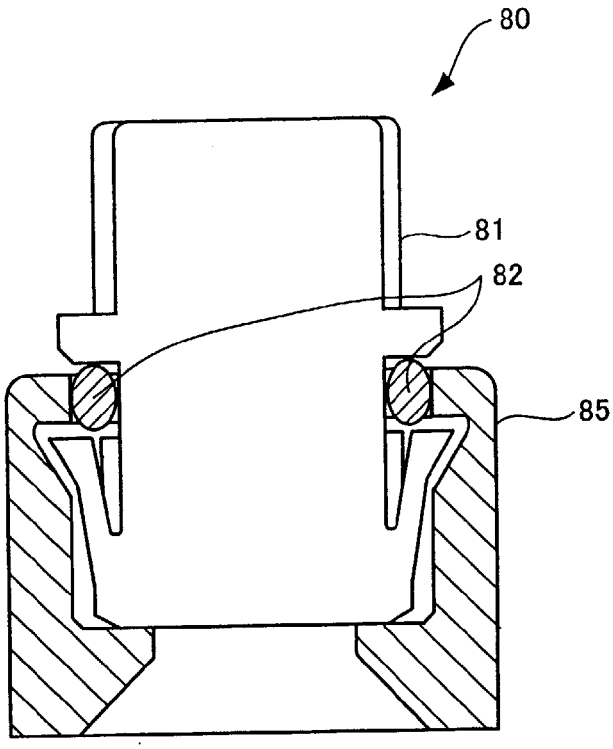
Fig. 8 (Prior Art)
FIG. 8 is a cross-sectional view of a conventional waterproof electrical connector; and Prior Art
Figure 9:
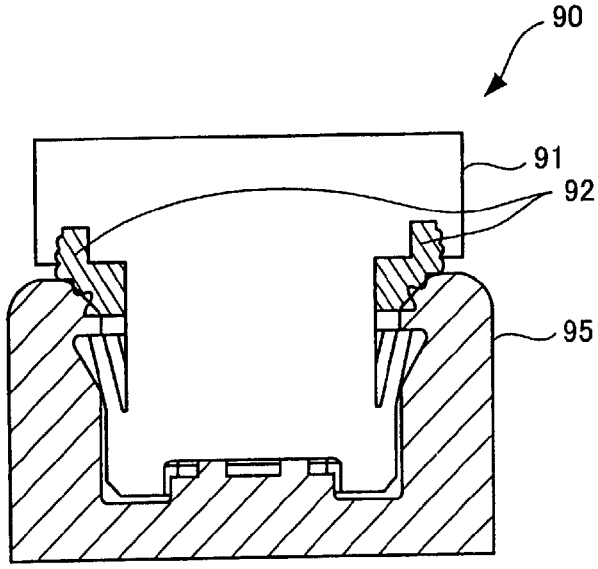
Fig. 9 (Prior Art)
FIG. 9 is a cross-sectional view of another type of conventional waterproof electrical connector.

As described above, according to the squib connector 10 of this embodiment, the seal 12 is arranged near the top end 111*c* of the fitting section 111*a*. Thus, even in a case, where the squib connector is connected to a mating connector 60 having an aperture portion on which a notch 60*a* is formed as shown in FIG. 7, the squib connector 10 is still waterproof. Furthermore, since the seal 12 is arranged on the outer periphery surface 111*d* near the top end 111*c* of the fitting section 111*a*, the seal 12 is not compressed so strongly as to be worn out even where the housing 11 is prevented exiting. As a result, the waterproof seal is stabilized.

Note that, in this embodiment, an example of the squib connector 10 has been explained. However, the present invention is not limited to this case. The present invention is applicable to waterproof electrical connectors for the other usages. It should be also noted that the waterproof electrical connector of the present invention can be used even at a position where condensation is likely to be formed. Thus, when the present invention is applied as the squib connector 10 connected to the ignition device for an automobile air bag, such a squib connector 10 can be used as a squib connector 10 of a curtain air bag or a side air bag that is installed inside the doors.

Moreover, according to this embodiment, descriptions have been made of the seal 12 provided with the lip 12*a*. However, the lip 12*a* may be formed in a multi-folded shape. For example, when the lip 12*a* is formed in dual folds, the waterproof seal is improved.

What is claimed is:

1. A waterproof electrical connector for electrically connecting at least one wire to a mating connector having a concavity, the waterproof electrical connector comprising:

a contact connected to an end of the wire;

a housing having a fitting section configured to at least partially house the contact and configured for insertion into the concavity;

a seal integrally arranged and adhered to the housing by insert-molding, the seal being positioned on an outer periphery surface near a top end of the fitting section, which sealingly contacts an inner wall of the concavity when the fitting section is inserted into the concavity, the seal being positioned in a recess in the outer periphery surface near a top end of the fitting section; and a lock being arranged on the outer periphery surface which prevents the housing from exiting the concavity once the fitting section has been inserted into concavity to a predetermined depth.

2. The waterproof electrical connector according to claim 1, wherein a rear of the seal is further positioned within a groove of the housing.

3. The waterproof electrical connector according to claim 1, wherein the wire is adhered to the housing with a hot melt material.

4. The waterproof electrical connector according to claim 1, wherein the waterproof electrical connector is a squib connector.

5. The waterproof electrical connector according to claim 4, wherein the squib connector is connected to an ignition device of an air bag.

6. The waterproof electrical connector according to claim 4, wherein the squib connector is connected to an ignition device of a curtain air bag.

7. The waterproof electrical connector according to claim 4, wherein the squib connector is connected to an ignition device of a side air bag.

8. The waterproof electrical connector according to claim 4, wherein the squib connector is installed in a door of a vehicle.

9. A squib connector, comprising:

a housing having a fitting section;

a ring shaped seal integrally arranged and adhered to the housing by insert-molding, the seal being positioned on an outer periphery surface of the fitting section near a top end of the fitting section; and a lock being formed on the outer periphery surface.

10. The squib connector according to claim 9, wherein a rear of the seal is further positioned within a groove of the housing.

11. The squib connector according to claim 9, wherein the seal is constructed of oil-impregnated silicone rubber.

12. The squib connector according to claim 9, wherein the seal is formed at the same time as a housing main body.

13. The squib connector according to claim 9, wherein the lock extends outward from the outer periphery surface.

14. The squib connector according to claim 13, wherein the seal is formed between the lock and the top end of the fitting section.

15. A waterproof electrical connector for electrically connecting at least one wire to a mating connector having a concavity, the waterproof electrical connector comprising:

a contact connected to an end of the wire;

a housing having a fitting section configured to at least partially house the contact and configured for insertion into the concavity;

a seal integrally arranged and adhered to the housing by double injection molding, the seal being positioned with an outer periphery surface near a top end of the fitting section, which sealingly contacts an inner wall of the concavity when the fitting section is inserted into the concavity; and a lock being arranged on the outer periphery surface which prevents the housing from exiting the concavity once the fitting section has been inserted into concavity to a predetermined depth.

16. The waterproof electrical connector according to claim 15, wherein a rear of the seal is further positioned within a groove of the housing.

17. The waterproof electrical connector according to claim 15, wherein the wire is adhered to the housing with a hot melt material.

18. A squib connector, comprising:

a housing having a fitting section;

a ring shaped seal integrally arranged and adhered to the housing by double injection molding, the seal being positioned on an outer periphery surface of the fitting section near a top end of the fitting section,; and a lock being formed on the outer periphery surface.

19. The squib connector according to claim 18, wherein a rear of the seal is further positioned within a groove of the housing.

20. The squib connector according to claim 18, wherein the seal is constructed of oil-impregnated silicone rubber.

21. The squib connector according to claim 18, wherein the seal is formed at the same time as a housing main body.

22. The squib connector according to claim 18, wherein the lock extends outward from the outer periphery surface.

23. The squib connector according to claim 22, wherein the seal is formed between the lock and the top end of the fitting section.

* * * * *